US008031560B1

(12) United States Patent
Washington

(10) Patent No.: US 8,031,560 B1
(45) Date of Patent: Oct. 4, 2011

(54) OPEN EYES ALARM CLOCK

(76) Inventor: Kenneth Washington, Oakland, CA (US)

( * ) Notice: Subject to any disclaimer, the term of this patent is extended or adjusted under 35 U.S.C. 154(b) by 0 days.

(21) Appl. No.: 12/561,436

(22) Filed: Sep. 17, 2009

(51) Int. Cl.
*G04C 17/00* (2006.01)
*G04B 23/00* (2006.01)

(52) U.S. Cl. ..... 368/244; 368/241; 368/256

(58) Field of Classification Search ..... 368/10, 368/241, 256, 276, 244
See application file for complete search history.

(56) References Cited

U.S. PATENT DOCUMENTS

| | | | | |
|---|---|---|---|---|
| 4,777,474 | A | 10/1988 | Clayton | |
| 4,910,652 | A * | 3/1990 | Rhine | 362/234 |
| 5,270,466 | A * | 12/1993 | Haley | 544/293 |
| 5,551,879 | A * | 9/1996 | Raynie et al. | 434/236 |
| 5,686,882 | A | 11/1997 | Giani | |
| 5,894,455 | A | 4/1999 | Sikes | |
| 6,008,720 | A * | 12/1999 | Hongu et al. | 340/309.16 |
| 6,088,836 | A * | 7/2000 | de Cordova | 2/171 |
| 6,502,060 | B1 * | 12/2002 | Christian | 702/178 |
| 6,961,286 | B1 * | 11/2005 | Alagia | 368/10 |
| 7,155,025 | B1 * | 12/2006 | Weffer | 381/370 |
| 7,173,881 | B1 | 2/2007 | Freudenberg et al. | |
| 7,202,774 | B2 | 4/2007 | Hoyle | |
| 7,245,273 | B2 * | 7/2007 | Eberl et al. | 345/7 |
| 2003/0026170 | A1 * | 2/2003 | Yang | 368/10 |
| 2007/0217290 | A1 | 9/2007 | Rock | |
| 2008/0170476 | A1 * | 7/2008 | Hurst | 368/250 |
| 2009/0105524 | A1 * | 4/2009 | Bressler et al. | 600/27 |

* cited by examiner

*Primary Examiner* — Sean Kayes
(74) *Attorney, Agent, or Firm* — Kyle Fletcher

(57) ABSTRACT

The open eyes alarm clock consists of a sleeping mask that wraps around an end user's head, which includes speakers located in the general vicinity of an end user's ears as well as light emitting means affixed along interior surfaces covering the eyes. The open eyes alarm clock is designed to emit an audio and/or visual alarm in order to awake persons that have either a hearing impairment or that are deep sleepers.

7 Claims, 5 Drawing Sheets

OPEN EYES ALARM CLOCK

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of alarm clocks, more specifically, a wake up alarm system that is worn about the head of an end user and of which presents both an audible and visual alarm to wake up said end user.

B. Discussion of the Prior Art

As a preliminary note, it should be stated that there is an ample amount of prior art that deals with alarm clocks. As will be discussed immediately below, no prior art discloses an alarm clock that resembles a night mask that is designed to help the hearing impaired as well as the morning impaired awake.

The Hoyle Patent (U.S. Pat. No. 7,202,774) discloses an eye shield sleeping device that includes a timer for a set of speakers, wherein the timer creates an awakening sound, and wherein a second embodiment includes a transducer for the generation of a visible output. However, the device does not include a timer for setting a preset time for awakening an end user via an audible and/or visual signal.

The Clayton Patent (U.S. Pat. No. 4,777,474) discloses an alarm system for the hearing impaired. However, the alarm system does not include a night sleeping mask that is worn about the end user's head, and of which can emit an audio, visual, or audiovisual alarm.

The Rock Patent Application Publication (U.S. Pub. No. 2007/0217290) discloses an alarm clock that turns on a light at a preset time. However, the alarm clock is not a night sleeping mask worn about an end user's head of which can emit an audio, visual, or audiovisual alarms to awaken said end user.

The Giani Patent (U.S. Pat. No. 5,686,882) discloses a silent alarm wristband. However, the wristband is not worn about an end user's head in order to emit an audio, visual, or audiovisual alarm adjacent said end user's eyes or ears.

The Freudenberg, Jr., et al. Patent (U.S. Pat. No. 7,173,881) discloses an alarm system for providing silent notification to a user. However, the silent morning alarm system involves the use of wristbands that are worn about a wrist of an end user and silently awakes said end user while not disturbing person (s) sleeping in the near vicinity of said end user, as opposed to a night sleeping mask.

The Sikes Patent (U.S. Pat. No. 5,894,455) discloses an alarm clock with an ear insert. However, the alarm clock does not include a night sleeping mask that can also emit an audio signal in order to awake persons that having hearing impairments.

While the above-described devices fulfill their respective and particular objects and requirements, they do not describe a mud flap composed of an alarm clock that resembles a night mask that is designed to help the hearing impaired as well as the morning impaired awake from sleep via an audible alarm and/or visual alarm. In this regard, the current invention departs from the conventional concepts and designs of the prior art.

SUMMARY OF THE INVENTION

The open eyes alarm clock consists of a sleeping mask that wraps around an end user's head, which includes speakers located in the general vicinity of an end user's ears as well as light emitting means affixed along interior surfaces covering the eyes. The open eyes alarm clock is designed to emit an audio and/or visual alarm in order to awake persons that have either a hearing impairment or that are deep sleepers.

It is an object of the invention to provide an alarm system that provides multiple alarm functions comprising audible, visual, or audiovisual.

A further object of the invention is to provide an alarm system that is designed to wake up persons having hearing impairments or those that are deep sleepers.

It is a further object of the invention to provide an alarm system that doubles as a night sleeping mask that fits over the eyes and ears of end user in order to aid in the process of falling asleep.

It is a further object of the invention to provide an alarm system that is lightweight, affordable, easy to use, and effective.

These together with additional objects, features and advantages of the open eyes alarm clock will be readily apparent to those of ordinary skill in the art upon reading the following detailed description of presently preferred, but nonetheless illustrative, embodiments of the open eyes alarm clock when taken in conjunction with the accompanying drawings.

In this respect, before explaining the current embodiments of the open eyes alarm clock in detail, it is to be understood that the open eyes alarm clock is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the open eyes alarm clock.

It is therefore important that the claims be regarded as including such equivalent construction insofar as they do not depart from the spirit and scope of the open eyes alarm clock. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
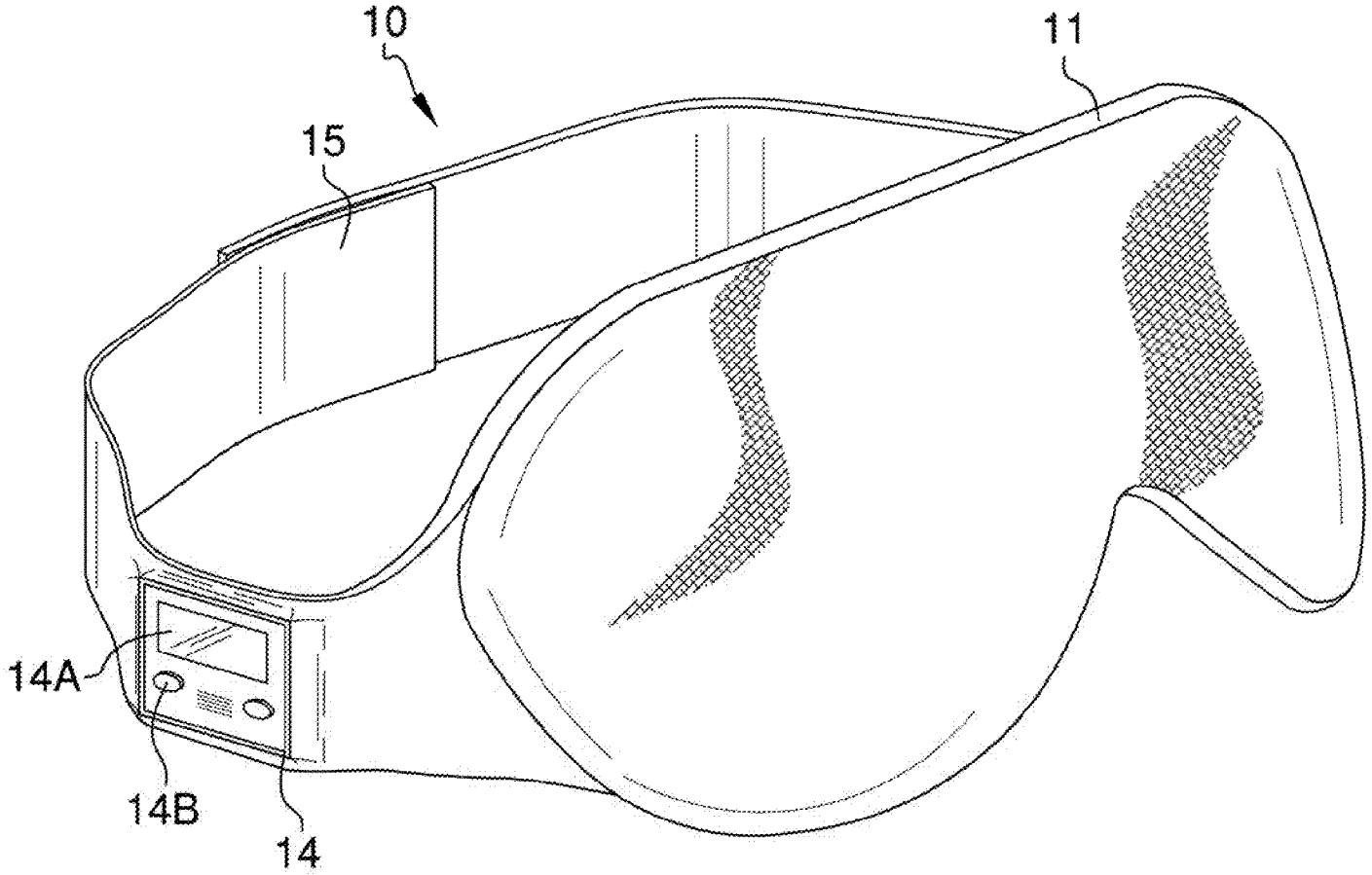
FIG. 1 illustrates a front, isometric view of the open eyes alarm clock with the head straps attached.
Figure 2:
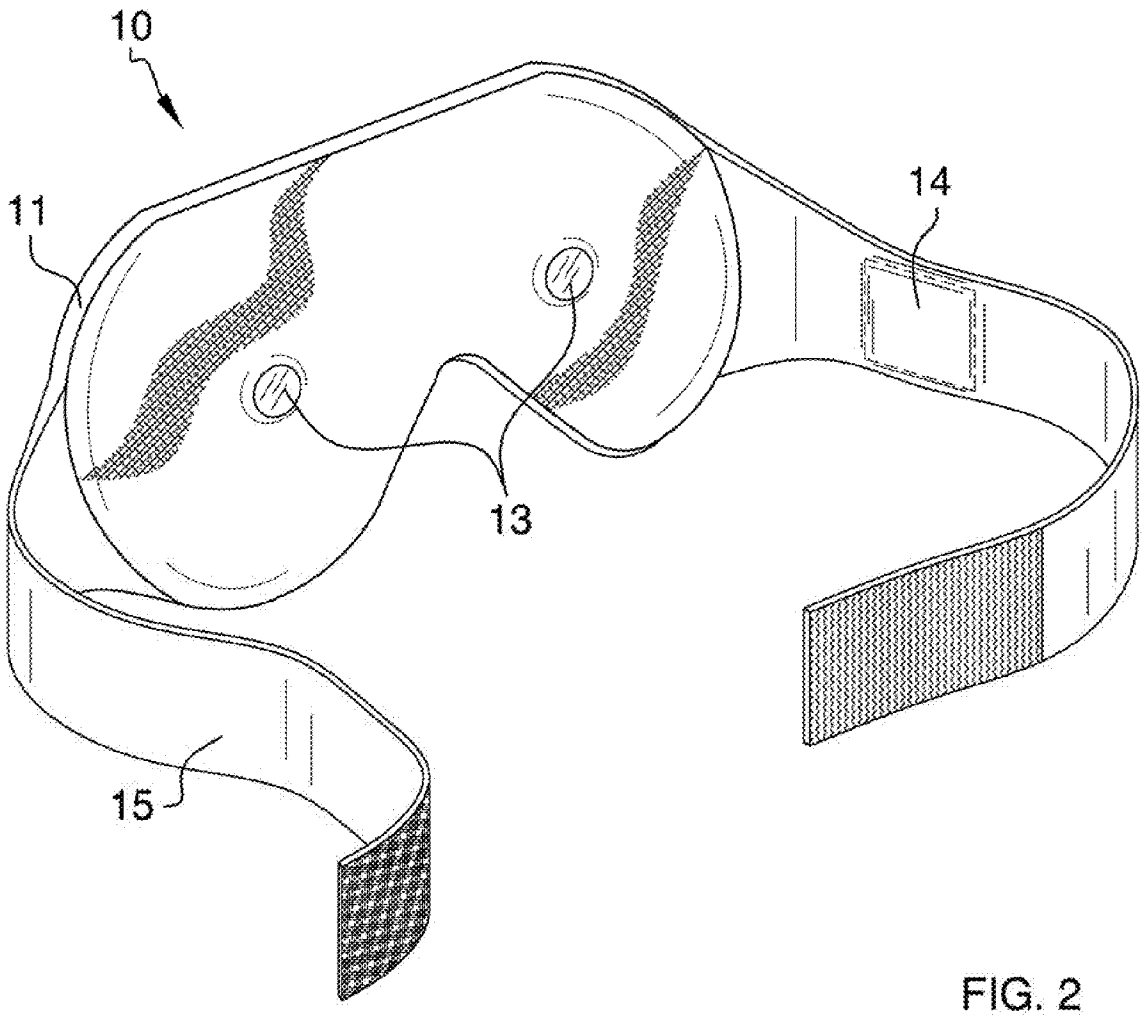
FIG. 2 illustrates a rear, isometric view of the open eyes alarm clock with the head straps detached.
Figure 3:
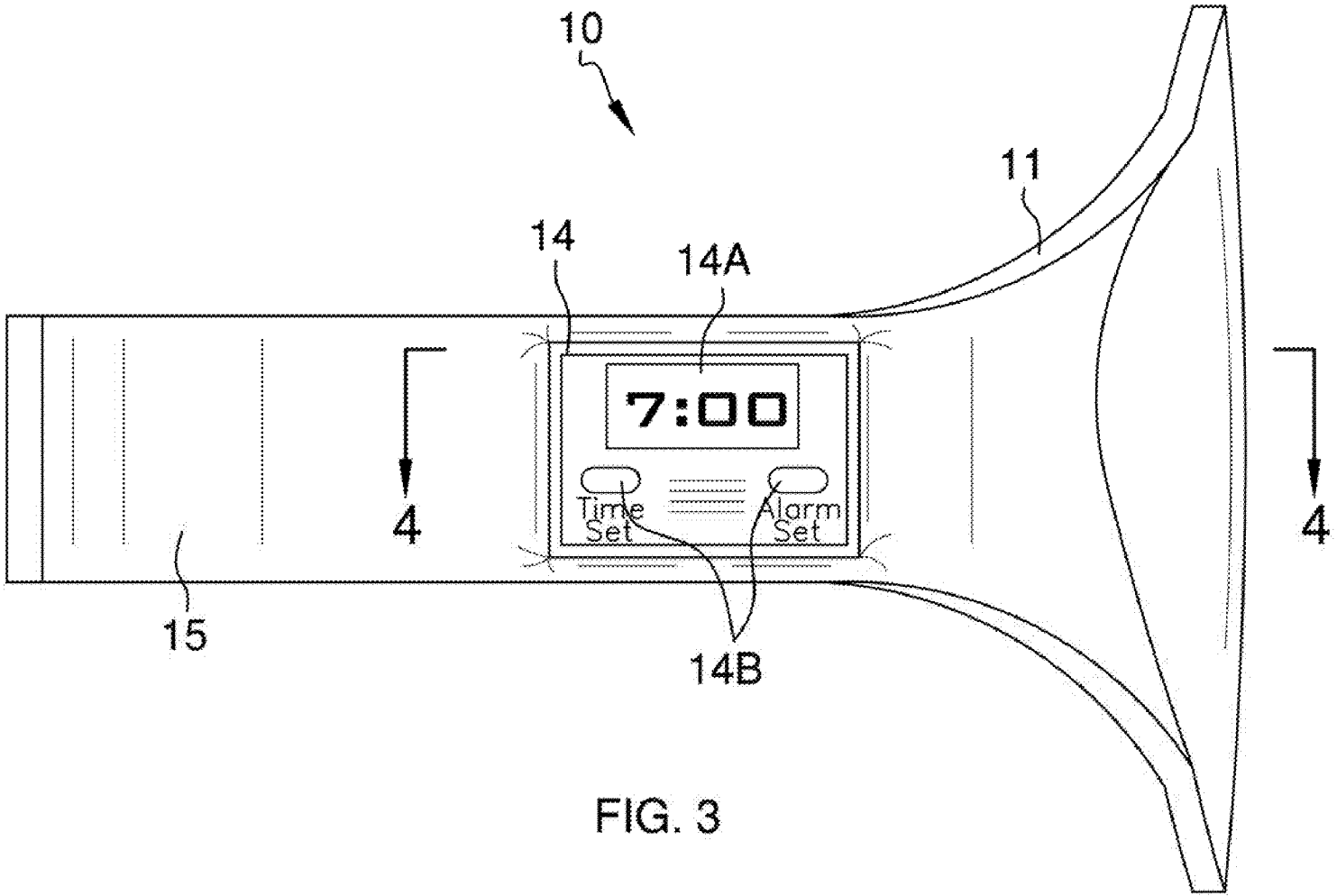
FIG. 3 illustrates a side view of the open eyes alarm clock, and detailing the alarm clock as well as control buttons.
Figure 4:
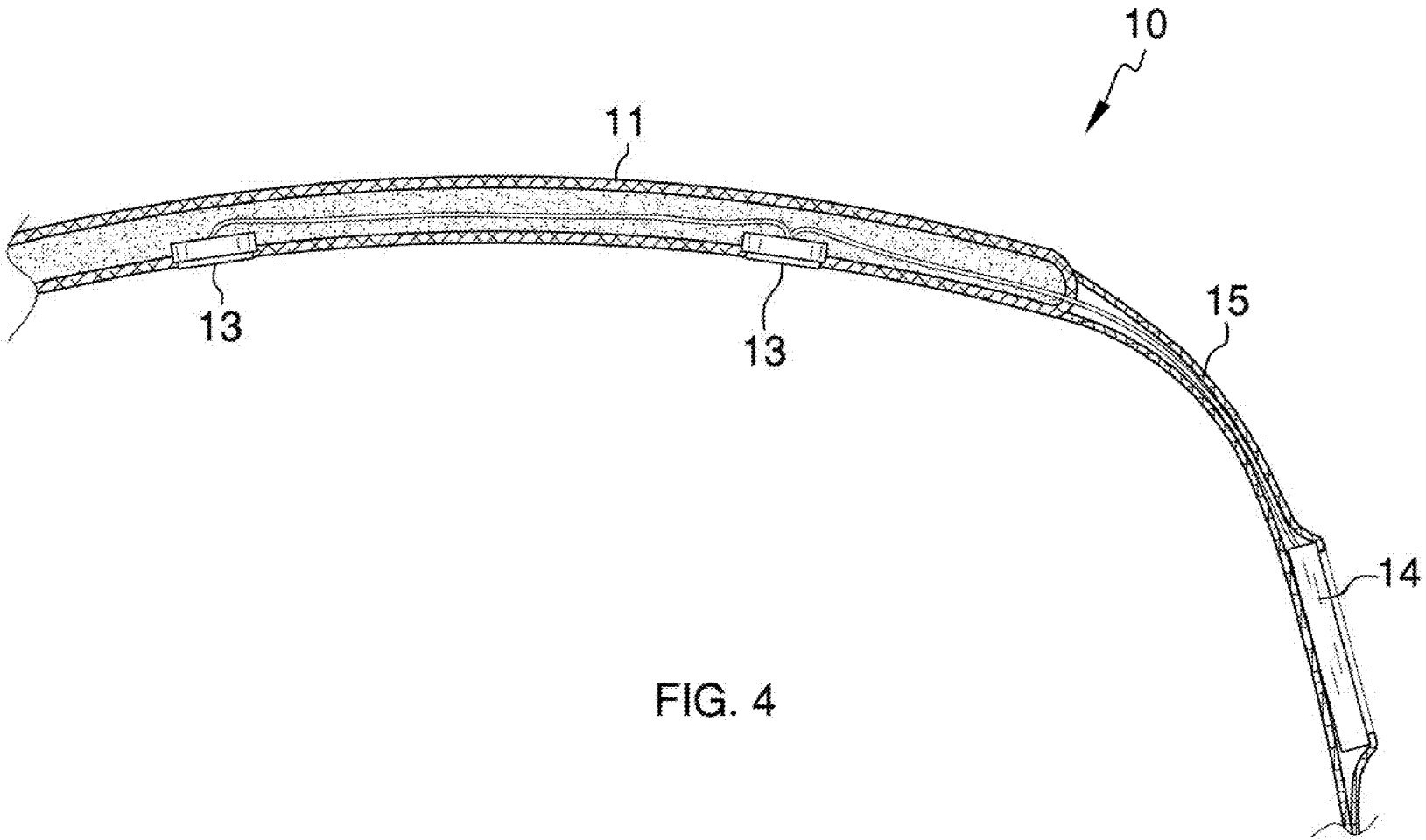
FIG. 4 illustrates a cross-sectional view of the open eyes alarm clock along line 4-4 in FIG. 3, and detailing the light emitting means wired to the alarm clock.
Figure 5:
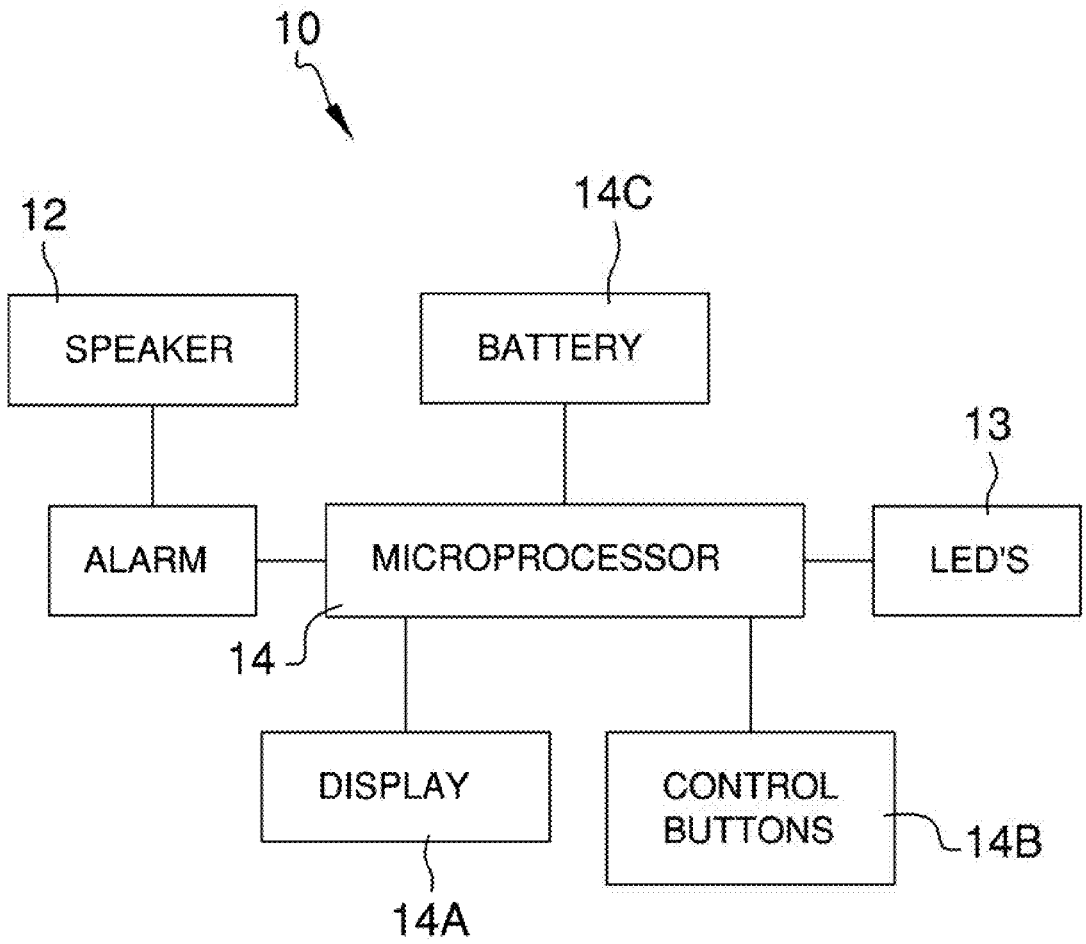
FIG. 5 illustrates a diagram of the various components of the invention.

Detailed reference will now be made to the first embodiment of the present invention, examples of which are illustrated in FIGS. 1-5. An open eyes alarm clock 10 (hereinafter invention) includes a sleeping mask 11, audible alarm means 12, visual alarm means 13, and an alarm clock 14.

The sleeping mask 11 attaches around a head via straps 15. The straps 15 secure to one another via attaching means comprising Velcro strips (aka nylon hook and loop strips), a zipper, snap buttons, or regular button(s) and corresponding hole(s). However, it shall be noted that the straps 15 shall fit snuggly around an end user's head, in a manner that prevents separation therefrom. It shall also be noted that the straps 15 may be permanently connected to one another, and require an elastic region to enable the device to be fitted over the head.

The sleeping mask 11 is made of a flexible material comprising a plastic, woven fabric, or rubber. The material of the sleeping mask 11 shall be made of a non-translucent material such that when said mask 11 is laid across the eyes of an end user will block out all light.

The alarm clock 14 provides the typical function of any traditional alarm clock, but in a sleek design that does not cause discomfort to the area adjacent the head. The alarm clock 14 includes a screen 14A for displaying time, as well as control buttons 14B. It shall be noted that the control buttons 14B are recessed and thus require a small object to be inserted in order to set the time or the alarm time.

The audible alarm means 12 consists of a pair of speakers that are outfitted on said mask 11 in the general vicinity of the ear (not shown) of the end user. The audible alarm is wired to the alarm clock 14.

The visual alarm means 13 consists of a plurality of light emitting diodes that are wired to the audible alarm 14. The visual alarm means 13 are located along an interior region of the mask 11 that is adjacent the eyes of the end user.

The alarm clock 14 can be set to provide an audio alarm, visual alarm, or audiovisual alarm. The selection of the desired alarm is controlled by one of the alarm control buttons 14B. The alarm clock will simply emit said selected alarm once the desired time has arrived.

The alarm clock 14 may also be referred to as a microprocessor 14. The alarm clock 14 is powered by at least one battery 14C.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An alarm clock further comprising:

a mask that is a head worn garb that wraps around said head, and of which covers both the eyes and ears of an end user, and wherein said mask has said alarm clock, an audible alarm means and a visual alarm means, and wherein said alarm clock controls both the audible alarm means and the visual alarm means;

wherein the audible alarm means consists of left and right speakers attached along an interior surface of said mask in an area adjacent a left and right ear of an end user;

wherein the visual alarm means consists of a plurality of light emitting diodes attached along an interior surface of said mask in an area that is adjacent eyes of an end user;

wherein the alarm clock includes a plurality of control buttons that provide for setting the time, setting an alarm, and dictating whether the alarm will be audible, visual, or audiovisual;

wherein said mask is worn by hearing impaired or morning impaired end users and shall provide both audible alarm means and visual alarm means thereto;

wherein the mask has straps that attach to encircle the mask about an end user's head;

wherein the alarm clock is wired to both the audible alarm means and the visual alarm means;

wherein the alarm clock includes a display for displaying the time;

wherein the control buttons are recessed, in order to prevent unwanted depression.

2. The alarm clock as described in claim 1 wherein the mask is made of a material comprising a plastic, rubber, or woven fabric.

3. The alarm clock as described in claim 2 wherein the mask is made of a non-translucent material.

4. The alarm clock as described in claim 1 wherein the straps attach to one another via attaching means comprising nylon hook and loop strips, a zipper, snap buttons, or button and corresponding hole.

5. An alarm clock further comprising:

a mask that is a head worn garb that wraps around said head, and which is made of a non-translucent material, and of which covers both the eyes and ears of an end user, wherein said mask has said alarm clock, an audible alarm means and a visual alarm means, and wherein said alarm clock is wired to and controls both the audible alarm means and the visual alarm means;

wherein said mask has straps that attach to one another to secure the mask about an end user's head;

wherein the audible alarm means consists of left and right speakers attached along an interior surface of said mask in an area adjacent a left and right ear of an end user;

wherein the visual alarm means consists of a plurality of light emitting diodes attached along an interior surface of said mask in an area that is adjacent eyes of an end user;

wherein the alarm clock includes a plurality of control buttons that provide for setting the time, setting an alarm, and dictating whether the alarm will be audible, visual, or audiovisual;

wherein said mask is worn by hearing impaired or morning impaired end users and shall provide both audible alarm means and visual alarm means thereto;

wherein the alarm clock includes a display for displaying the time; and wherein the control buttons are recessed, in order to prevent unwanted depression.

6. The alarm clock as described in claim 5 wherein the mask is made of a material comprising a plastic, rubber, or woven fabric.

7. The alarm clock as described in claim 5 wherein the straps attach to one another via attaching means comprising nylon hook and loop strips, a zipper, snap buttons, or button and corresponding hole.

* * * * *